US005896723A

United States Patent [19]

Sing

[11] Patent Number: 5,896,723

[45] Date of Patent: Apr. 27, 1999

[54] LAMINATED WOOD STRUCTURAL UNITS

[76] Inventor: Peter Sing, P.O. Box 11532, Winslow, Wash. 98110

[21] Appl. No.: 08/726,583

[22] Filed: Oct. 7, 1996

Related U.S. Application Data

[63] Continuation-in-part of application No. 08/493,011, Jun. 21, 1995, Pat. No. 5,618,371.

[51] Int. Cl.[6] ..... E04C 1/00; B27M 1/08

[52] U.S. Cl. ..... 52/730.7; 52/731.2; 52/233; 52/732.1

[58] Field of Search ..... 52/730.7, 730.1, 52/731.2, 732.1, 729.4, 233

[56] References Cited

U.S. PATENT DOCUMENTS

| | | | |
|---|---|---|---|
| Re. 35,327 | 9/1996 | Sing | 52/730.7 X |
| 323,424 | 8/1885 | Jackson | 52/729.4 |
| 1,953,460 | 4/1934 | Bernhard | 52/233 |
| 2,118,048 | 5/1938 | Landsem | 52/730.7 |
| 3,445,325 | 5/1969 | Clark | 52/730.7 X |
| 3,552,079 | 1/1971 | Mortensen | 52/592.6 |
| 4,115,969 | 9/1978 | Napier | 52/233 |
| 4,336,678 | 6/1982 | Peters | 52/730.7 X |
| 4,807,413 | 2/1989 | Randall | 52/233 |
| 5,115,609 | 5/1992 | Sing | 52/730.7 X |
| 5,163,259 | 11/1992 | Hunsaker et al. | 52/233 |
| 5,299,400 | 4/1994 | Sing | 52/233 X |
| 5,485,794 | 1/1996 | Sing | 52/233 X |
| 5,618,371 | 4/1997 | Sing | 52/731.1 X |

FOREIGN PATENT DOCUMENTS

| | | | |
|---|---|---|---|
| 167117 | 3/1950 | Austria | 52/233 |
| 2318828 | 10/1974 | Germany | 52/233 |
| 3006303 | 8/1981 | Germany | 52/233 |
| 178136 | 9/1935 | Switzerland | 52/730.1 |
| 374816 | 3/1964 | Switzerland | 52/233 |
| WO 90/14475 | 11/1990 | WIPO | 52/233 |

*Primary Examiner*—Carl D. Friedman
*Assistant Examiner*—Laura A. Callo
*Attorney, Agent, or Firm*—Nathaniel Altman

[57] ABSTRACT

Small-diameter logs are longitudinally bisected and trimmed to form a flattened surface parallel and opposite the diametric surface formed by the bisection. All longitudinal surfaces of logs, half-logs and planks not visible in the final product are subjected to an overall pattern of cuts or perforations to relieve uneven wood fiber tension, the two half logs are adhesively joined at their trimmed flattened surfaces, the patterned cuts may be filled with adhesive; vertical piles of at least three planks are treated similarly. After adhesive has set a second longitudinal bisection is made through the half-log or plank-pile assembly, resulting in two asymmetric structural units, which are piled in a tight stack to discourage warping or twisting as the stack is subjected to air- or kiln-drying. The dried structural units may be then assembled into rectangular beams or a plurality of them may be aligned parallelly into uniform planar arrays for use as paneling, siding, fencing, flooring or decking; tongue-and-grooved laminates of structural units are also provided for assembling strong weather-resistant structures.

12 Claims, 3 Drawing Sheets

60a
56a
62a
58a 64a
66a
68a 64b
66b
70

56a
70
46a
50a
48a
10c 52a
70
56a
52a
54a 70
52b 72
74
52c
76

64b
78
64a
64a 80
64a
66a 64
80a
66

82
84
68a
66a 68
82a
28
26
66
64

86
68a
88
64a
66a 86a
68
64
66

LAMINATED WOOD STRUCTURAL UNITS

BACKGROUND OF THE INVENTION

This application, a continuation-in-part of U.S. patent application Ser. No. 08/493,011, filed Jun. 21, 1995 now U.S. Pat. No. 5,618,371 discloses and claims subject matter not previously considered, taught or claimed in, as well as matter restricted from, the parent application, which uses less-than-perfect half-logs or planks together with spacers to produce its space-containing wood beams. The method of the present invention provides structural products such as paneling, siding, fencing, flooring and the like, in addition to beams; the method also provides an answer to the problem that a significant percentage of small-diameter logs, when handled by conventional methods, are not suitable for use in structural lumber products because of warping and twisting. These distortions, especially severe in new-growth small logs, cause the discarding of up to 20% of an otherwise useful and valuable raw material; by applying the procedures of the method hereinafter disclosed, at least 95% of available logs of this category can be converted successfully into profitable structural products.

FIELD OF THE INVENTION

This invention is directed to the production of laminated wood products such as space-containing beams, paneling, siding, fencing, flooring and the like from small-diameter logs and conventional planks.

SUMMARY OF THE INVENTION

The basic starting materials for producing the products of this invention are half-logs and conventional lumber planks all cut from at least one log and used in varying combinations. To create the half-logs for use, whole logs are bisected longitudinally either at the same time or after a pair of trimming flattening cuts parallel to the lengthwise bisecting cut on each log are made; optionally, a second pair of parallel longitudinal trimming cuts at right angles to the first pair may be advantageously included.

A matched pair of lengths of the half-logs thus prepared are positioned so that one is superposed over the other, the flattened surfaces parallel to the diametric bisected surfaces facing one another; adhesive is applied to the flattened surfaces, which are then joined alignedly and held together until the adhesive is caused to set. The resulting symmetrical half-log intermediate assembly is then longitudinally bisected along a plane perpendicular to its upper and lower diametric bisected surfaces, thus forming two asymmetric mirror-image structural units for later assembly into the beams, siding, flooring, fencing, etc. of this invention, as hereinafter described.

In similar manner, conventional pre-cut lumber planks may be laminated by adhesively joining them to form aligned vertically stacked piles for bisecting into sections and use in assembly with each other, with other tongue-and-groove planks, or combined with the bisected half-log units into the structural wood products of this invention.

The problem of warping and twisting occurring in logs and portions cut therefrom is largely caused by uneven tension of the wood fibers, the effect of which is particularly evident as the log portions are dried. By making patterned cuts or perforations into those longitudinal log or plank surfaces which will not be exposed to view in the ultimate product made therefrom, the fiber tension is greatly relieved, most effectively before the logs or planks are dried, and the warping and twisting tendencies of the logs or lumber products created from them are significantly reduced or eliminated. For logs to be used to make space-containing beams, the tension-relieving patterned cuts are made into the log before bisection; for those used for siding, paneling, etc., the patterned cuts may be made after the bisection, so that the parallel diametric and flattened surfaces of the half-logs may be cut in patterns along with the log's original outer surface. In both cases, the two half-logs are then arranged so that the flattened surfaces of each face each other, and adhesive is applied to the flattened surfaces; at the same time, the patterned cuts or perforations may be filled with the same adhesive. Pre-cut lumber planks surfaces may be pattern-cut and treated analogously to the half-logs. Both are then bisected; the resulting units of half-log or plank-based units are then piled into a stack and air- or kiln-dried, thereafter being assembled into the beams, paneling, etc. of this invention.

Details of all the steps and embodiments of the invention will be fully disclosed and described in connection with the accompanying illustrative, but not limiting, drawings, wherein:

SHORT FIGURE DESCRIPTION OF THE DRAWINGS

Figure 3:
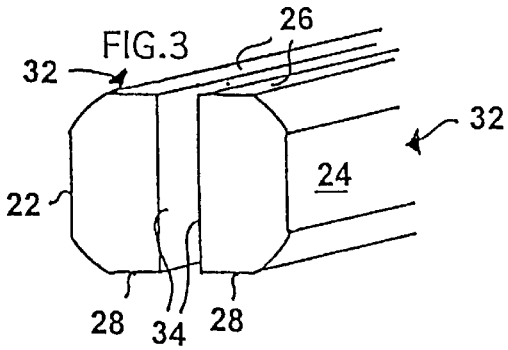
FIG. 3 is a schematic end right perspective partial view of the two half-logs formed by the bisection indicated in FIG. 2.
Figure 6:
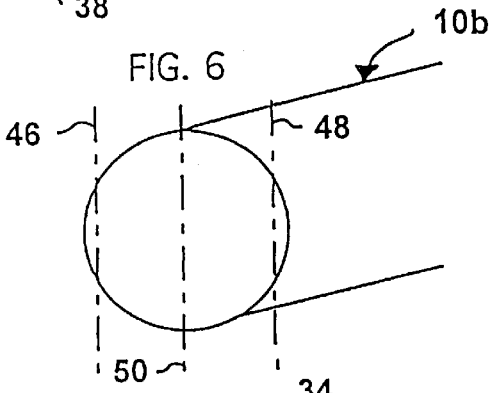
FIG. 6 is a schematic end right perspective partial view of a log in position to be longitudinally trimmed and bisected simultaneously by three parallel cuts into two half-logs.
Figure 7:
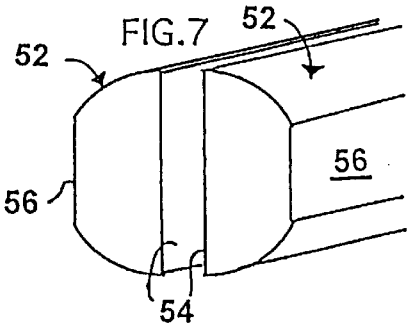
Figure 8:
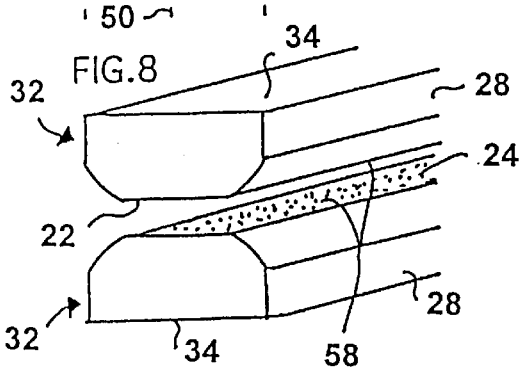
Figure 9:
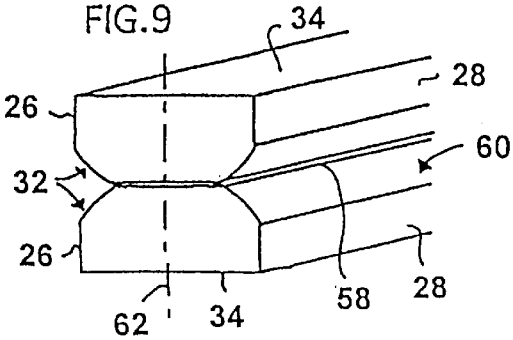
Figure 10:
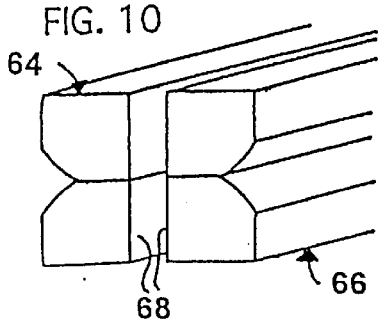
Figures 11, 12, 13, 14, 15, 16, 17, 18, 19, 20, 21, 22, 23, 24:
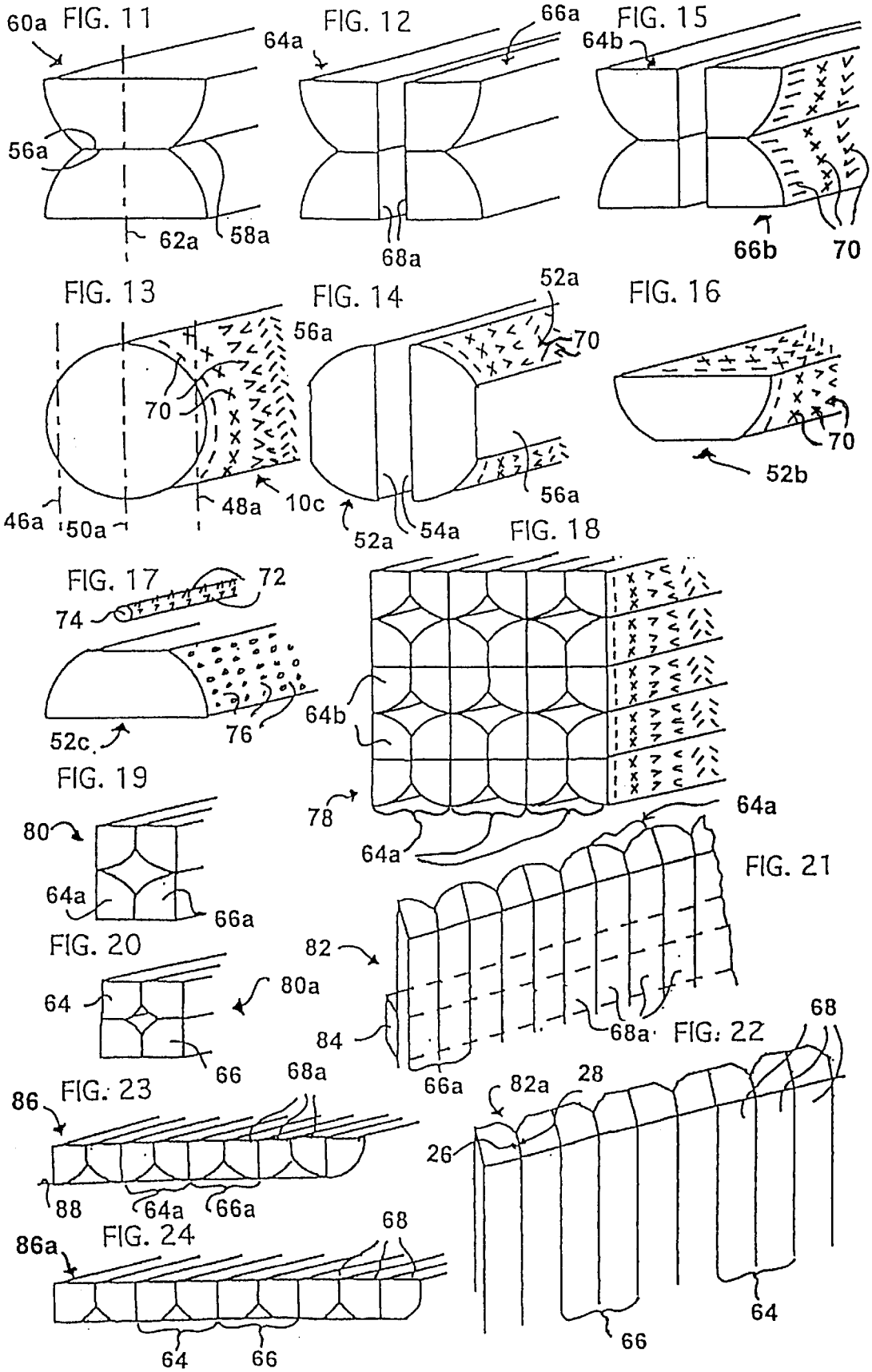
Figure 25:
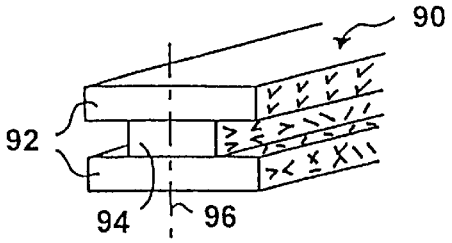
Figure 26:
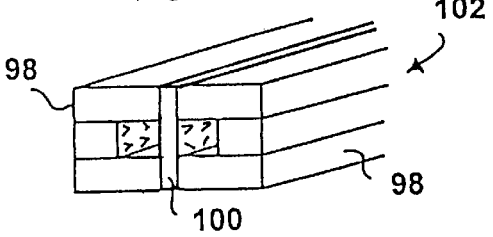
Figure 27:
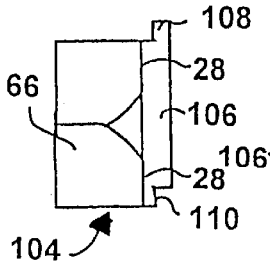
Figure 28:
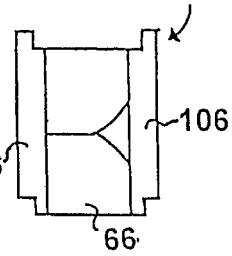
Figure 29:
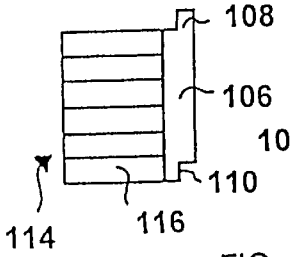
Figure 30:
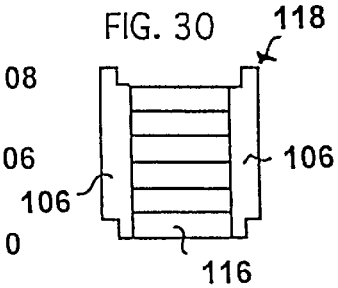
Figure 31:
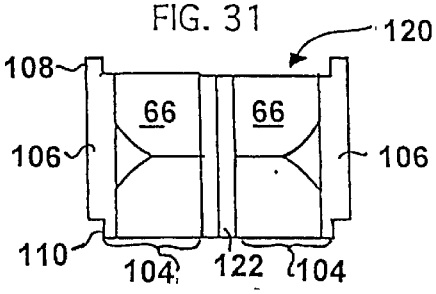
Figure 32:
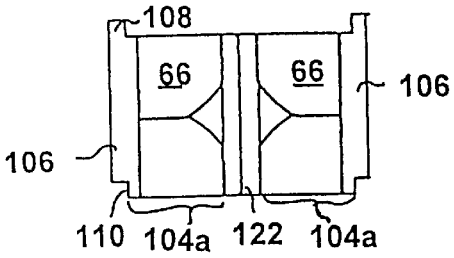
Figure 33:
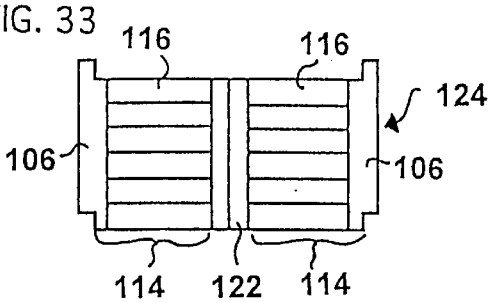
Figure 37:
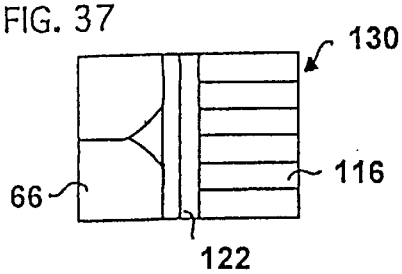
Figure 34:
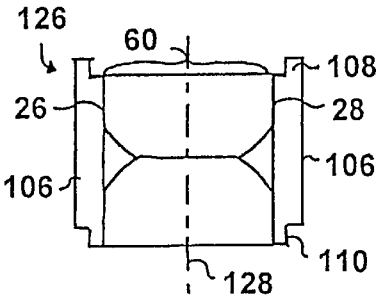
Figure 35:
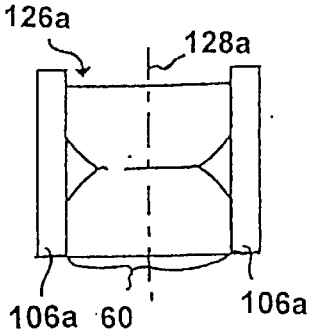
Figure 36:
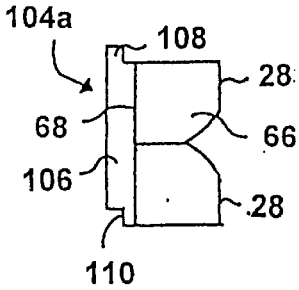

FIG. 7 in a schematic end right perspective partial view of the two half-logs formed from the bisection indicated in FIG. 6;

FIG. 8 is a schematic end right perspective partial view of the half-logs of FIG. 3, one alignedly superposed over the other, in position to be assembled;

FIG. 9 is a schematic end right perspective partial view of the completed half-log assembly of FIG. 8 in position to be longitudinally bisected;

FIG. 10 is a schematic end right perspective partial view of the two asymmetric mirror-image units resulting from the bisection of FIG. 9;

FIG. 11 is a schematic end right perspective partial view of the half-logs of FIG. 7 alignedly and adhesively assembled, comparable to the assembly of FIG. 8 and in position for bisection;

FIG. 12 is a schematic end right perspective partial view of the two asymmetric mirror-image units resulting from the bisection of FIG. 11;

FIG. 13 is a schematic end right perpective partial view of a log, the circumferential surface of which has been subjected to a variety of patterned cuts, in position to be trimmed and bisected longitudinally and simultaneously by three parallel cuts;

FIG. 14 is a schematic end right perspective partial view of the two half-logs formed in FIG. 13;

FIG. 15 is a schematic end right perspective partial view of the two asymmetric mirror-image units formed from the half-logs of FIG. 14 after they have been adhesively assembled and bisected like those of FIG. 11;

FIG. 16 is a schematic end right perspective partial view of a half-log, the longitudinal surfaces of which have been subjected to patterned cuts;

FIG. 17 is a schematic end right perspective partial view of a half-log, the longitudinal surfaces of which have been perforated by a spiked roller in an overall pattern;

FIG. 18 is a schematic end right perspective partial view of a plurality of asymmetric mirror-image units like those of FIG. 15 stacked in a pile for air- or kiln-drying;

FIG. 19 is a schematic end right perspective partial view of a beam assembled from two rearranged units like those of FIG. 15;

FIG. 20 is a schematic end right perspective partial view of a beam assembled from two rearranged units like those of FIG. 10 which have been pattern-cut, piled and dried before assembly;

FIG. 21 is a front left perspective partial view of paneling or a fence assembled from a plurality of asymmetric mirror-image units like those of FIG. 12;

FIG. 22 is a front left perspective partial view of paneling or a fence assembled from a plurality of asymmetric mirror-image units like those of FIG. 10;

FIG. 23 is a front right perspective partial view of a floor or deck assembled from a plurality of asymmetric mirror-image structural units like those of FIG. 12;

FIG. 24 is a front right perspective partial view of a floor or deck assembled from a plurality of asymmetric mirror-image units like those of FIG. 10;

FIG. 25 is a front right perspective partial view of an intermediate assembly of three planks, pattern-cut before assembly on all longitudinal surfaces that will be not visible in the finished product, in position to be bisected;

FIG. 26 is a front right perspective partial view of an assembled beam formed from the units created by the bisection indicated in FIG. 25;

FIG. 27 is an end elevational view of one of the units of FIG. 10 laminated to a tongue-and-grooved plank;

FIG. 28 is an end elevational view of one of the units of FIG. 10 laminated to a tongue-and-grooved plank on each side thereof;

FIG. 29 is an end elevational view of a plurality of planks laminated together in a vertical pile with a tongue-and-grooved plank laminated on one side thereof;

FIG. 30 is an end elevational view of a plurality of planks laminated together in a vertical pile with a tongue-and-grooved plank laminated on each side thereof;

FIG. 31 is an end elevational view of a laminated composite beam having two FIG. 10 units with a laminated plank therebetween and tongue-and-grooved planks laminated on each side thereof;

FIG. 32 is an end elevational view similar to FIG. 31, but with the two FIG. 10 units in reversed position;

FIG. 33 is an end elevational view of a laminated composite beam similar to FIG. 31, but with the FIG. 10 units replaced by laminated vertical piles of planks;

FIG. 34 is an end elevational view of a laminated beam composed of a FIG. 10 unit, a laminated vertical pile of planks and a laminated plank positioned therebetween;

FIG. 35 is an end elevational view of the half-log intermediate assembly of FIG. 9 with a tongue-and-grooved plank laminated on each side thereof, in position to be bisected;

FIG. 36 is an end elevational view similar to FIG. 35, but with plain planks laminated on either side; and FIG. 37 is an end elevational view similar to FIG. 27 but with the position of the FIG. 10 unit reversed.

DESCRIPTION OF THE PREFERRED EMBODIMENTS

Figure 1:
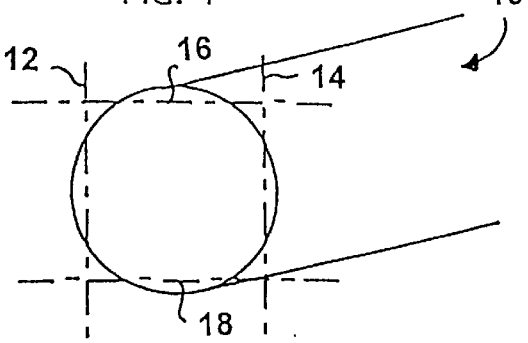
FIG. 1 is a schematic end right perspective partial view of a log in position to be trimmed longitudinally by four simultaneous cuts.
Figure 2:
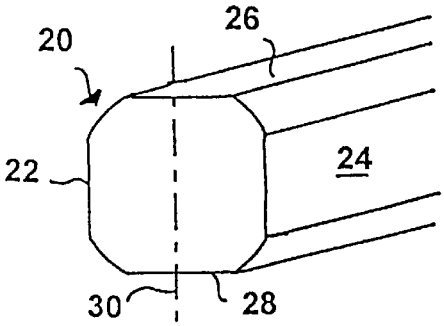
FIG. 2 is a schematic right perspective partial view of the trimmed log of FIG. 1 in position to be bisected.
Figure 4:
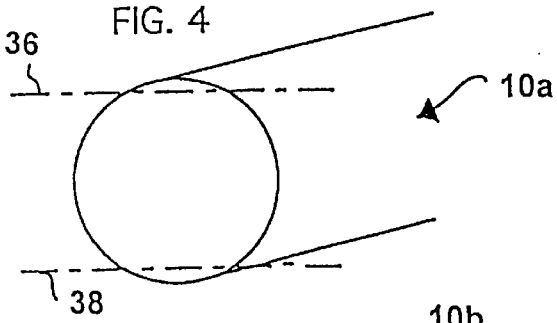
FIG. 4 is a schematic end right perspective partial view of a log in position to be trimmed longitudinally by two parallel simultaneous cuts.
Figure 5:
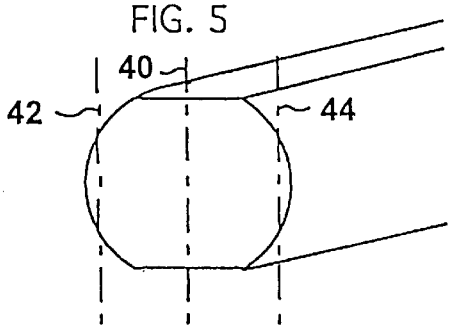
FIG. 5 is a schematic end right perspective partial view of the log of FIG. 4 in position to be trimmed and bisected longitudinally and simultaneousy by three parallel cuts into two trimmed half-logs.

FIGS. 1–3 illustrate a preferred method of producing half-logs for use in this invention. In FIG. 1, log 10 is in position to be "squared" by simultaneous longitudinal trimming vertical cuts 12 and 14 and horizontal cuts 16 and 18, to produce trimmed log 20, with flattened surfaces 22, 24, 26, and 28 of FIG. 2. Trimmed log 20 is to be longitudinally bisected along plane 30, resulting in the formation of half-logs 32 each with a diametrically cut surface 34. An alternate method of achieving identical half-logs 32 is shown in FIGS. 4 and 5; in FIG. 4, a first cutting step involves two parallel opposite longitudinal trimming cuts 36 and 38 along log 10*a*, followed in FIG. 5 by three longitudinal parallel cuts at right angles to cuts 36 and 38, including bisecting cut 40 and trimming cuts 42, 44, resulting in two half-logs 32 as shown in FIG. 3.

Another embodiment of half-logs to be used for this invention appears in FIGS. 6 and 7, where log 10*b* is converted by a single cutting step of three longitudinal parallel cuts, trimming cuts 46,48 and bisecting cut 50, into two half-logs 52, each with diametric surface 54 and flattened surface 56 parallel and opposite thereto.

FIG. 8 illustrates the joining of the two half-logs 32 shown in FIG. 3, with trimmed flattened surface 22 alignedly and symmetrically superposed and facing corresponding flattened surface 24, both surfaces having been selectively coated with adhesive 58 and being ready to be contacted, adhesive 58 caused to set, thus forming symmetrical intermediate assembly 60 shown in FIG. 9. Assembly 60 is then to be longitudinally bisected along plane 62 of FIG. 9 perpendicular to diametric surfaces 34, resulting in the formation of asymmetric mirror-image units 64 and 66, each with a new flat surface 68 created by the bisection and depicted in FIG. 10.

The joining of half-logs 52 from FIG. 7 is a procedure identical to that shown for half-logs 32 in FIGS. 8–10, and the steps of superposing, coating with adhesive, contacting the flattened surfaces and causing the adhesive to set have not been reillustrated; however, symmetrical intermediate assembly 60*a* is shown in FIG. 11 with flattened surfaces 56*a* of half-logs 52 adhesively joined by set adhesive 58*a* and with assembly 60*a* in position to be bisected longitudinally along plane 62*a* to produce asymmetric mirror-image structural units 64*a*, 66*a* of FIG. 12. It may be noted that sections 64, 66, 64*a* and 66*a* are primary structural units for the products of this invention, and they may be used interchangeably in a1 half-log-based products herein-after disclosed.

To minimize or eliminate warping and twisting of half-logs and planks used in the products of this invention, the method disclosed in FIGS. 13–18 and 25–26 is highly effective. When handled by conventional methods, up to 20% of logs or their parts, depending in part on the species of wood, have to be rejected or discarded for structural product use because of wood fiber tension distortion; up to 95% of these discards may be avoided by the method hereinafter described.

For best results in the practice of this invention, the logs used should be preferably in the diameter size range of four to twelve inches and in undried "green" condition, to provide maximum opportunity for the tension-releasing patterned cuts and perforations of this invention to be most effective. Using this procedure with previously dried logs or planks will help against warping and twisting, but to a somewhat lesser degree.

FIG. 13 shows log 10*c*, the circumferential surface of which has had cuts 70 with an illustrative pattern of assorted shapes at varying angles, including lines parallel, transverse and angular to the longitudinal axis of log 10*c* and thus to wood fiber strands therein, V's and X's in all attitudes. It may be noted that in practicing this invention, any single one, or any combination, of the patterned cuts 70 indicated in the drawings may be used to good effect; it may be noted also that the ability of cuts 70 to reduce uneven fiber tension and thereby to reduce distortion of log 10*c* is not significantly affected by whether or not log 10*c* has been debarked. The depth of cuts 70 should range from at least 5% to no more than 20% of the thickness of the log or half-log at the point where each cut 70 (or perforation 76, FIG. 17) is made, when cuts 70 are not treated further, but where cuts 70 are to be filled with adhesive when the half-logs are coated, their depth may be increased to as much as 35% of the log's, half-log's or plank's thickness without reducing the strength of the final product.

The bisecting and trimming of log 10*c* by parallel longitudinal cuts along planes 46*a* 48*a* and 50*a* in FIG. 13 results in two half-logs 52*a* shown in FIG. 14, each having a planar diametric surface 54*a* and parallel trimmed surfaces 56*a* free of cuts 70. For the manufacture of space-containing beams (see FIG. 19), surfaces 54*a* of half-logs 52*a* form part of the outer exposed portion of the finished beam and hence cannot be pattern-cut; and surfaces 56*a* are to be joined adhesively together (as in FIGS. 8,9). so that their being pattern-cut as a separate step is optional and does not significantly contribute to overcoming warping or twisting significantly; units 64*b* and 66*b* formed by the joining of half-logs 52*a* by bisection of the intermediate assembly thereof (not shown) appear in FIG. 15. In contrast, for the production of siding, paneling, flooring, etc., none of the outer longitudinal surfaces of half-log 52*b* in FIG. 16 will be visible when the final product is assembled; therefore, the log from which half-log 52*b* was cut (not shown) was bisected and trimmed before pattern-cuts 70 over all the longitudinal surfaces of half-log 52*b* were made.

An alternative pre-treatment of logs (not shown) or half-logs is illustrated in FIG. 17, where the surfaces of half-log 52*c* have been penetrated by spikes 72 of roller 74, forming an overall pattern of perforations 76 therein to relieve the half-log's fiber tension.

FIG. 18 illustrates the next step in the procedure to which each of the asymmetric mirror-image units 64, 66, 64*a*, 66*a*, 64*b* and 66*b* are identically treated; for simplicity, only the units 64*a* and 66*a* are shown herein, it being understood that the other units are to be handled exactly the same way. Structural units 64*a*, 66*a* are shown piled into stack 78 in FIG. 18, in position to be allowed to air-dry or to be placed in a kiln for force-drying. The weight of units 64*a*, 66*a* on each other and the restraint of their side-by-side positioning as the drying process occurs help to overcome any residual tendency for warping or twisting therein. After drying, the mirror-image asymmetric units are ready to be assembled into the structural products described in the following drawings.

Space-containing wood beam 80 shown in FIG. 19 has been assembled by arranging two dried units 64*a*, 66*a*, made from half-logs 56, in position so that cut faces 54 and 68*a* form the rectangular outer profile of the finished beam and no pattern cuts 70 are visible thereon. In FIG. 20, the space-containing beam 80*a* is identical to beam 80 except that it has been assembled with sections 64, 66 from half-logs 32 of log 10, flattened on four sides; as a result, beam 80*a* is square rather than rectangular in cross-section.

FIG. 21 shows vertical assembly 82 of dried units 64*a*, 66*a* made from half-logs 52, 52*a*, 52*b* or 52*c* which might serve as paneling, fencing, or, when turned 90 degrees, as siding (not shown). Here, only the surfaces 68*a*, which have a uniform planar uncut aspect, are visible in finished products. Units 64, 64*a* may be held in position and supported in any convenient way, one of which, transverse plank 84 is shown. Exactly analogously, vertical assembly 82*a* of dried units 64, 66 in FIG. 22 may be used for the same purposes as assembly 82, and because of the extra flat trimmed surfaces 26 and 28 provided thereon, is more compact and stronger, with units 64, 66 held together by adhesive or conventional methods and presenting smooth planar surfaces 68 to view.

The same structural units as those used for paneling, etc. in FIGS. 21 and 22 are shown in FIGS. 23 and 24, respectively, attached in horizontal array to provide flooring or decking; thus, in FIG. 23, a plurality of units 64*a*, 66*a* joined and fixed together in a horizontal row, with only planar uncut surfaces 68*a* exposed, form floor or deck 86 mounted on support 88; in FIG. 24, units 64, 66 are similarly joined horizontally and mounted on support 88*a* to form floor or deck 86*a*, with surfaces 68 acting as the floor or deck surface.

FIGS. 25 and 26 illustrate the use of the fiber-tension-relief method described above on pre-cut planks. Intermediate assembly 90 shown in FIG. 25 comprises identical upper and lower planks 92 sandwiching therebetween narrower plank 94 in a symmetrical pile alignedly and adhesively held together, to be bisected longitudinally along plane 96 to form asymmetric mirror-image units 98 seen in FIG. 26 adhesively combined with spacing element 100 to form beam 102. Planks 92 and 94 have pattern-cuts 70 made on all surfaces that will be concealed in finished beam 102, either before or after intermediate assembly 90 is formed, to minimize or eliminate fiber tension and consequent warping.

An assortment of laminated wood structural products assembled in accordance with this invention of superior characteristics are illustrated in FIGS. 27–36, featuring tongue-and grooved planks adhesively secured to asymmetric log units and/or piles of laminated planks. The resulting siding or beams, when erected, form structures of greatly enhanced strength, stability and weather resistance, eliminating air and water penetration. FIG. 27 shows siding 104 comprising asymmetric mirror-image unit 66 (or 64), its flattened surfaces 28 (or 26) being laminated to plank 106, which has longitudinally extending tongue 108 along its top edge and groove 110 along its bottom; FIG. 36 has siding 104*a* with tongue-and-grooved plank 106 laminated to the opposite surface 68 of unit 66; and beam or siding 112 in FIG. 28 is exactly like siding 104, except that a second tongue-and-grooved plank 106 has been laminated to unit 66 on its side opposite first plank 106. FIG. 29 shows siding 114 with laminated vertical plank pile 116 replacing unit 66 of siding 104, and FIG. 30 has beam 118 with plank pile 116 replacing section 66 of beam 112.

The double-tongue-and grooved beam 120 of FIG. 31 is composed of two siding assemblies 104, surfaces 68 of which are adhesively joined on either side of laminated wood panel 122; beam 120*a* of FIG. 32 has siding assemblies 104*a* replacing two assemblies 104 of FIG. 31, sandwiching therebetween laminated wood panel 122. In FIG. 33, beam 124 replaces the two siding assemblies 104 with laminated plank pile sidings 114 of FIG. 29.

Two alternate methods of producing siding 104 (FIG. 27) are illustrated in FIGS. 34 and 35. In FIG. 34, intermediate assembly 60 is prepared as described above, then a tongue-and-grooved plank 106 is laminated on either side to surfaces 26, 28 thereof, creating a beam 126 which may be used as such or thereafter bisected longitudinally along plane 128 to produce two mirror-image pieces of siding 104. The alternate method of FIG. 35, producing beam 126*a* is identical to that just described, except that planks 106*a* without tongues and grooves are laminated to surfaces 26, 28 of half-log intermadiate assembly 60. Beam 126*a* may be used as such, may have tongue-and-groove cuts made in one or both planks 106*a* after assembly, or may be longitudinally bisected along plane 128*a* to form identical structural units, which may then be provided with tongue and groove if desired.

A final illustrative embodiment of this invention is shown in FIG. 37, wherein composite rectangular beam 130 is shown comprising asymmetric half-log-derived unit 66 and laminated vertically stacked plank pile 116 secured adhesively to laminated wood panel therebetween. It may be noted that beam 130 may be used as is or may have a tongue-and-grooved plank 106 or a plain plank 106a adhesively mounted on either side thereof.

The methods of this invention are applicable to the wide variety of wood species available; for example, the choice of hardwood for floors or decking and such species as cedar and Douglas fir for panelling or siding will be obvious. It also will be apparent that this invention makes it possible to utilize small-diameter newer-growth logs more fully instead of relying on relatively scarce and expensive old-growth timber, and using wood of lesser quality where not visible.

Best modes now contemplated for practicing this invention and its concepts have been fully described. It will be evident to those skilled in the art that modifications, alterations and substitutions may be made in the details of the procedures and products disclosed without departing from the spirit and concepts of this invention, which are limited only by the scope of the ensuing claims, wherein:

What is claimed is:

1. Laminated wood structural units, for further assembly into beams, paneling, siding, fencing, flooring and decking, said laminated wood structural units each being elongate equal-length elements formed from at least two portions of at least one log, said log portions being selected from the group consisting of half-logs, pre-cut lumber planks and combinations thereof, each said log portion having parallel planar upper and lower longitudinal surfaces, said elongate equal-length elements being formed by superposing and centrally aligning one of said at least two log portions over the other of said at least two log portions and joining them adhesively together in a vertical pile to form a laminated intermediate assembly, said intermediate assembly being symmetrical in cross-section, and bisecting said intermediate assembly by a longitudinal cut along an axis perpendicular to said upper and lower surfaces, whereby the resulting two said elongate equal-sized log elements cut from said intermediate assembly are asymmetric mirror-image forms of said laminated wood structural units, each of said two laminated wood structural units being separate and independent of each other.

2. Laminated structural units as defined in claim 1, wherein said symmetrical intermediate assembly is so configured and dimensioned that said assembly's upper and lower portions are wider than the center portion thereof.

3. A space-containing wood beam of rectangular cross-section made of laminated wood structural units as defined in claim 2, wherein two said asymmetric mirror-image structural units, having been formed from said at least two log portions selected from the group consisting of at least one said half-log combined with at least one said pre-cut plank and said pre-cut planks, have been positioned so that the sides thereof which had been the outer sides of said intermediate assembly now face each other and are adhesively joined to form said space-containing wood beam of rectangular cross-section.

4. Laminated wood structural units for further assembly into beams, paneling, siding, fencing, flooring and decking as defined in claim 1, wherein selected surfaces of said at least two log portions not to be visible in said beams, paneling, siding, fencing, flooring and decking assembled from said wood structural units have been cut into with multiple cuts in an overall intermittent pattern before the forming of said intermediate assembly, said multiple surface cuts being made to sever the wood fibers at and adjacent said selected surfaces and thus to relieve uneven wood fiber tension in said log portions, said overall intermittent pattern being selected from the group consisting of cuts parallel to said log portion's longitudinal axis, transverse cuts perpendicular to said log portion's longitudinal axis, parallel cuts taken at an angle to said log portion's longitudinal axis, v-shaped cuts, x-shaped cuts, perforations distributed over all said not-to-be visible selected surfaces and combinations of the above.

5. Laminated wood structural units as defined in claim 4, wherein said log portions are formed of said half-logs and said intermittent cuts and perforations made in an overall pattern into said half-logs' surfaces penetrate to a depth of at least 5% and not more than 20% of the thickness of each said half-log, without significant loss of strength in said laminated wood structural units formed therefrom.

6. Laminated wood structural units as defined in claim 5, wherein the depth of said intermittent cuts and perforation made in an overall pattern is extended up to 35% of the thickness of each said log portion at the point where each said cut and perforation is made and wherein said cuts and perforations are subsequently filled with adhesive.

7. A combined uniform planar array made of laminated wood structural units as defined in claim 1, wherein a plurality of said asymmetric mirror-image structural units are aligned and secured in side-by-side relationship, with the surfaces created by said bisecting of said intermediate assemblies forming the surfaces of said combined uniform planar array, said array being utilized as flooring and decking with said surfaces created by bisecting said intermediate assemblies extending in a horizontal plane, and being utilized as paneling, siding and fencing with said surfaces created by bisecting said intermediate assemblies extending in a vertical plane.

8. Laminated wood structural units as defined in claim 1, further comprising a pre-cut lumber plank laminated to and extending the length of at least one longitudinal side face of each said laminated wood structural unit.

9. Laminated wood structural unit as defined in claim 8, wherein each said laminated plank is provided with a tongue extending upwardly along one longitudinal edge thereof and with a matching complementary longitudinal groove along the opposite edge thereof.

10. A wood structural unit made of laminated wood structural units as defined in claim 8, wherein each of two said laminated wood structural units has said pre-cut lumber plank laminated to said one longitudinal face thereof, the opposite longitudinal faces of said two laminated wood structural units each being laminated to a common pre-cut lumber plank therebetween.

11. Laminated wood structural units as defined in claim 1, wherein said log portions comprise two said half-logs cut diametrically and longitudinally from said at least one log, each said half-log being trimmed to form a flat planar surface opposite and parallel to the diametrically cut surface thereof, said flat planar surface of one said half-log being superposed, aligned with and adhesively joined to said flat planar surface of the other of said two half-logs.

12. Laminated wood structural units as defined in claim 1, wherein said log portions comprise at least three said pre-cut lumber planks stacked and laminated together into said aligned symmetrical vertical pile.

* * * * *